US010273629B1

(12) United States Patent
Chen

(10) Patent No.: US 10,273,629 B1
(45) Date of Patent: Apr. 30, 2019

(54) STEAM IRONING MACHINE WITH MULTIPLE WATER INLET POINTS AND MULTI-CAVITY ISOLATED WATER PATHS

(71) Applicant: Xianpeng Chen, Liling (CN)

(72) Inventor: Xianpeng Chen, Liling (CN)

( * ) Notice: Subject to any disclaimer, the term of this patent is extended or adjusted under 35 U.S.C. 154(b) by 0 days.

(21) Appl. No.: 15/871,064

(22) Filed: Jan. 15, 2018

(51) Int. Cl.
*D06F 75/14* (2006.01)
*D06F 75/26* (2006.01)

(52) U.S. Cl.
CPC ..... *D06F 75/14* (2013.01); *D06F 75/26* (2013.01)

(58) Field of Classification Search
CPC ..... D06F 75/00; D06F 75/06–75/26; D06F 75/38
See application file for complete search history.

(56) References Cited

U.S. PATENT DOCUMENTS 3,263,350 A * 8/1966 Carlos ..... D06F 75/12 38/77.7
4,180,928 A * 1/1980 Davidson ..... D06F 75/18 38/77.83
5,038,501 A * 8/1991 Hipp ..... D06F 75/18 38/77.5
5,628,131 A * 5/1997 Chasen ..... D06F 75/18 38/77.83
5,704,143 A * 1/1998 Kubicz ..... D06F 75/18 38/77.83
2006/0213092 A1* 9/2006 Di Leta ..... D06F 75/12 38/77.1

FOREIGN PATENT DOCUMENTS

EP 2436834 A1 * 4/2012
GB 2117012 A * 3/1982

* cited by examiner

*Primary Examiner* — Ismael Izaguirre
(74) *Attorney, Agent, or Firm* — Wayne & Ken, LLC; Tony Hom

(57) ABSTRACT

The present invention discloses a steam ironing machine with multiple water inlet points and multi-cavity isolated water paths, including a heating body. The heating body is concavely provided with a first containing cavity and a second containing cavity mutually isolated; an ironing board is connected to the heating body; the heating body is provided with a first steam outlet nozzle and a second steam outlet nozzle respectively in communication with the first containing cavity and the second containing cavity; a temperature sensor is arranged between the heating body and the ironing board to ensure the ironing temperature; and the first containing cavity and the second containing cavity are arranged to prevent the problems that condensate water is produced on the ironing board when the steam ironing machine operates and water is sprayed due to excessive water on one side when the steam ironing machine leans to one side.

10 Claims, 6 Drawing Sheets

STEAM IRONING MACHINE WITH MULTIPLE WATER INLET POINTS AND MULTI-CAVITY ISOLATED WATER PATHS

TECHNICAL FIELD

The present invention relates to a steam ironing machine with multiple water inlet points and multi-cavity isolated water paths, and particularly to a steam ironing machine with multiple water inlet points and multi-cavity isolated water paths which solves the problem of insufficient temperature.

BACKGROUND

The existing steam ironing machine comprises a housing and a spray head, a heating chamber is formed in the housing, water is directly filled in the heating chamber, the water in the heating chamber is heated by a heating element at the bottom of the heating chamber into steam which can iron clothes, and the steam is sprayed to unceasingly come into contact with clothes and soften the clothes so as to achieve the purpose of ironing; this kind of portable steam ironing machine is easy to have the problem of overtemperature during ironing and thus spoil the clothes, and it is also easy to cause water spray due to improper using angle and produce condensate water due to insufficient temperature of the ironing board.

Therefore, it is necessary to design a good steam ironing machine with multiple water inlet points and multi-cavity isolated water paths to overcome the above-mentioned problems.

SUMMARY

In the light of the problems faced by the background, the purpose of the present invention is to provide a steam ironing machine with multiple water inlet points and multi-cavity isolated water paths by comprising independent first containing cavity and second containing cavity as well as a temperature sensor to prevent the problems that condensate water is produced on the ironing board when the steam ironing machine operates and water is sprayed due to excessive water on one side when the steam ironing machine leans to one side.

To achieve the above purpose, the present invention adopts the following technical solution:

A steam ironing machine with multiple water inlet points and multi-cavity isolated water paths, comprising a heating body which is concavely provided with at least one first containing cavity and at least one second containing cavity, wherein the first containing cavity and the second containing cavity are mutually isolated and independently arranged, and the heating body is concavely provided with an accommodating cavity outside the first containing cavity and the second containing cavity; a heating pipe is arranged in the accommodating cavity; a sealing cover is mated with the heating body and is covered on the first containing cavity, the second containing cavity and the accommodating cavity; a water supply nozzle is arranged on the sealing cover and is provided with a first water inlet part and a second water inlet part corresponding to the first containing cavity and the second containing cavity; the first water inlet part and the first containing cavity are in communication with each other, and the second water inlet part and the second containing cavity are in communication with each other, an ironing board is connected to one side of the heating body away from the sealing cover; the heating body is provided with at least one first steam outlet nozzle and at least one second steam outlet nozzle which are respectively in communication with the first containing cavity and the second containing cavity; the ironing board has a contact surface and an ironing surface; a first through hole and a second through hole are formed in the ironing board corresponding to the first steam outlet nozzle and the second steam outlet nozzle; the first through hole and the second through hole respectively run through the contact surface to the ironing surface; and a temperature sensor is arranged between the heating body and the ironing board.

Further, a seal is arranged between the first steam outlet and the first through hole, another seal is arranged between the second steam outlet and the second through hole, and the seals are made of silica gel.

Further, each side of the heating body is provided with a fixed ring, the ironing board is provided with fixed columns corresponding to the fixed rings, internal threads are formed in the fixed columns, and each fixed ring and each fixed column are fixed by a bolt.

Further, a mounting hole is concavely formed in one side of the heating body close to the ironing board, the ironing board is provided with a concave part in a position corresponding to the mounting hole, and a temperature controller is arranged in the mounting hole and the concave part.

Further, the first containing cavity and the sealing cover form an independent cavity, the second containing cavity and the sealing cover form another independent cavity, and the contact surface is in close fit and contact with the heating body.

Further, the heating body is concavely provided with at least one third containing cavity; correspondingly, the water supply nozzle is provided with a third water inlet part, and the third containing cavity and the third water inlet part are in communication with each other, the first water inlet part, the second water inlet part and the third water inlet part are arranged in triangle and distributed uniformly; correspondingly, the heating body is provided with a third steam outlet nozzle, and a third through hole is formed in the ironing board; and the third containing cavity is in communication with the third steam outlet nozzle and the third through hole.

Further, an open hole is formed in the sealing cover; the water supply nozzle is provided with a body part; the first water inlet pan, the second water inlet part and the third water inlet part are formed by extending from the body part to the heating body respectively; the body part is located in the open hole; and the first water inlet part, the second water inlet part and the third water inlet part are respectively contained in the first containing cavity, the second containing cavity and the third containing cavity.

Further, one end of the body part away from the first water inlet part is provided with a step part which is abutted against the ironing surface beside the open hole.

Further, a locating slot is formed at the junction of the first containing cavity, the second containing cavity and the third containing cavity, the locating slot has a bottom surface and at least three side surfaces, and the body part is abutted against the bottom surface and the three side surfaces.

Further, the first steam outlet nozzle and the first through bole are staggered with each other and form a first steam outlet passage, the second steam outlet nozzle and the second through hole are staggered with each other and form a second steam outlet passage, the first steam outlet passage is not in a straight line, the second steam outlet passage is not in a straight line, the first steam outlet nozzle and the first through hole are arranged in parallel with each other, and the second steam outlet nozzle and the second through hole are arranged in parallel with each other.

Compared with the prior art, the present invention has the following beneficial effects:

In the steam ironing machine with multiple water inlet points and multi-cavity isolated water paths, a first containing cavity and a second containing cavity are mutually isolated and independently arranged, and a heating body is concavely provided with an accommodating cavity outside the first containing cavity and the second containing cavity; a heating pipe is arranged in the accommodating cavity; a sealing cover is mated with the heating body and is covered on the first containing cavity, the second containing cavity and the accommodating cavity; a water supply nozzle is arranged on the sealing cover and is provided with a first water inlet part and a second water inlet part corresponding to the first containing cavity and the second containing cavity; the first water inlet part and the first containing cavity are in communication with each other, and the second water inlet part and the second containing cavity are in communication with each other; an ironing board is connected to one side of the heating body away from the sealing cover; the heating body is provided with a first steam outlet nozzle and a second steam outlet nozzle which are respectively in communication with the first containing cavity and the second containing cavity; the ironing board has a contact surface and an ironing surface; a first through hole and a second through hole are formed in the ironing board corresponding to the first steam outlet nozzle and the second steam outlet nozzle; the first through hole and the second through hole respectively run through the contact surface to the ironing surface; a temperature sensor is arranged between the heating body and the ironing board so that the temperature of the ironing surface can be ensured and clothes will not be spoiled due to overtemperature; and the first containing cavity and the second containing cavity are arranged to prevent the problems that condensate water is produced on the ironing board when the steam ironing machine operates and water is sprayed due to excessive water on one side when the steam ironing machine leans to one side.

REFERENCE SIGNS IN DETAILED DESCRIPTION

| | | |
|---|---|---|
| Heating Body 1 | First Containing Cavity 11 | Second Containing Cavity 12 |
| Third Containing Cavity 13 | Accommodating Cavity 14 | First Steam Outlet Nozzle 15 |
| Second Steam Outlet Nozzle 16 | Third Steam Outlet Nozzle 17 | Locating Slot 18 |
| Bottom Surface 19 | Side Surface 20 | Mounting Hole 21 |
| Fixed Ring 22 | Heating Pipe 2 | Sealing Cover 3 |
| Open Hole 31 | Water Supply Nozzle 4 | Body Part 41 |
| First Water Inlet Part 42 | Second Water Inlet Part 43 | Third Water Inlet Part 44 |
| Step Part 45 | Ironing Board 5 | Contact Surface 51 |
| Ironing Surface 52 | First Through Hole 53 | Second Through Hole 54 |
| Third Through Hole 55 | Concave Part 56 | Fixed Column 57 |
| Seal 6 | | |

DETAILED DESCRIPTION

To understand the purposes, structure, features and functions of the present invention better, the present invention is further described in combination with drawings and specific embodiments.

Figure 1:
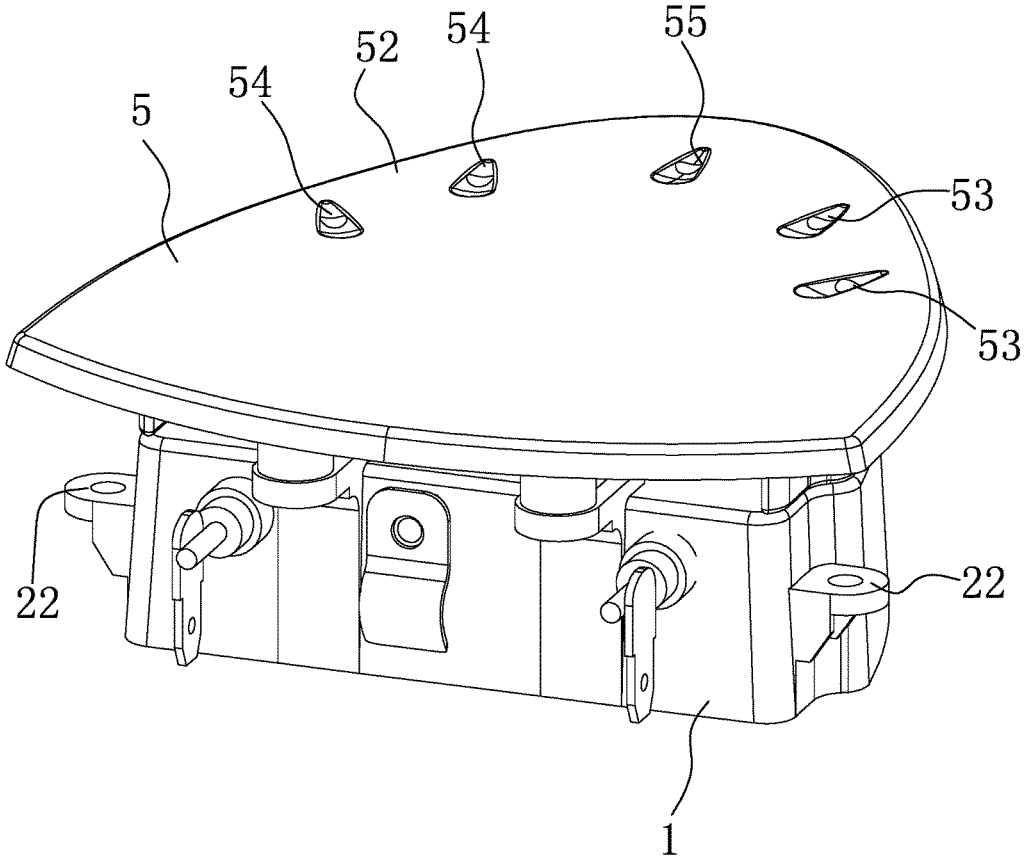
FIG. 1 is a schematic diagram of a steam ironing machine with multiple water inlet points and multi-cavity isolated water paths of the present invention.
Figure 3:
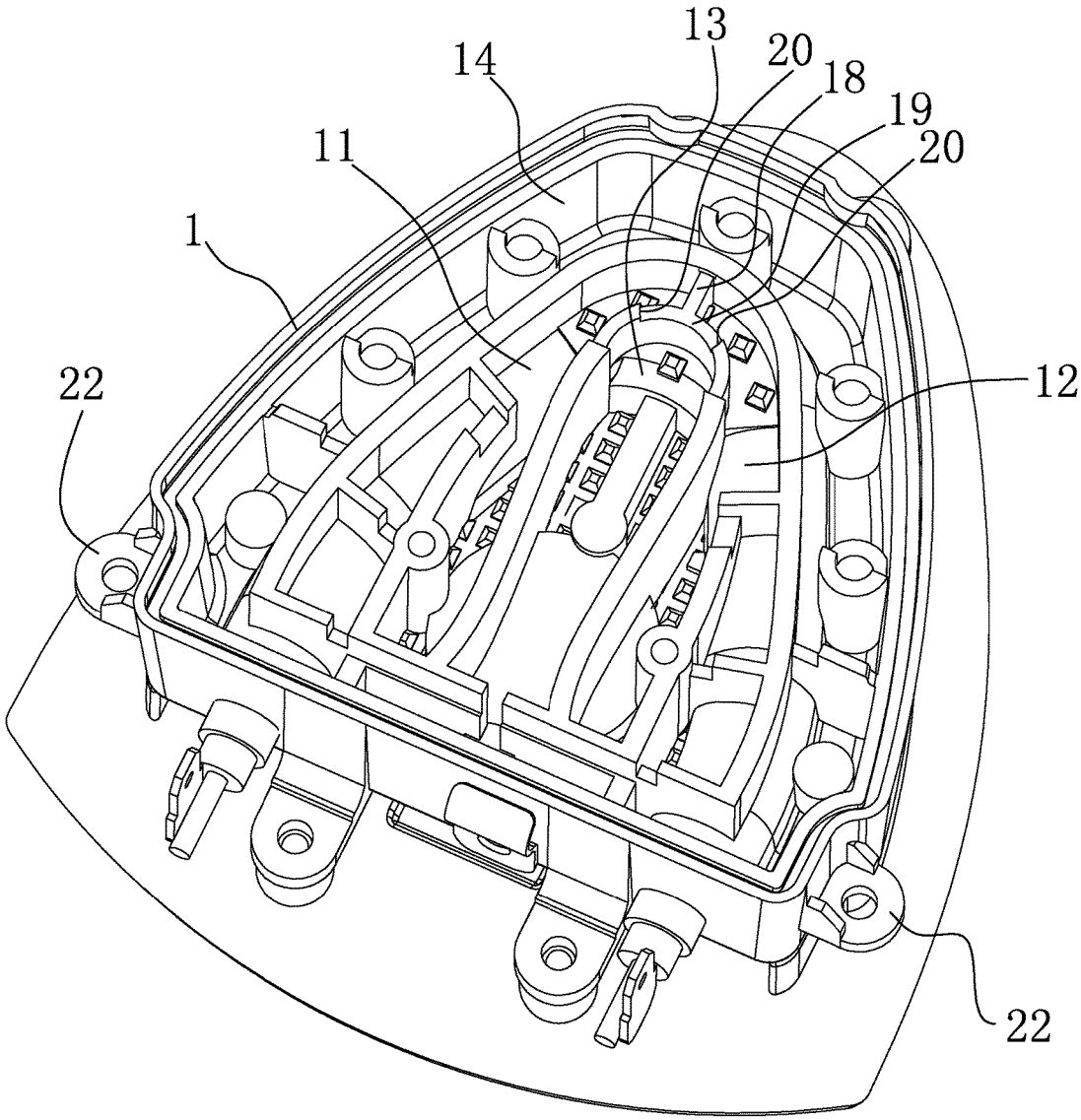
FIG. 3 is a schematic diagram of a steam ironing machine with multiple water inlet points and multi-cavity isolated water paths without a sealing cover and a water supply nozzle of the present invention.
Figure 5:
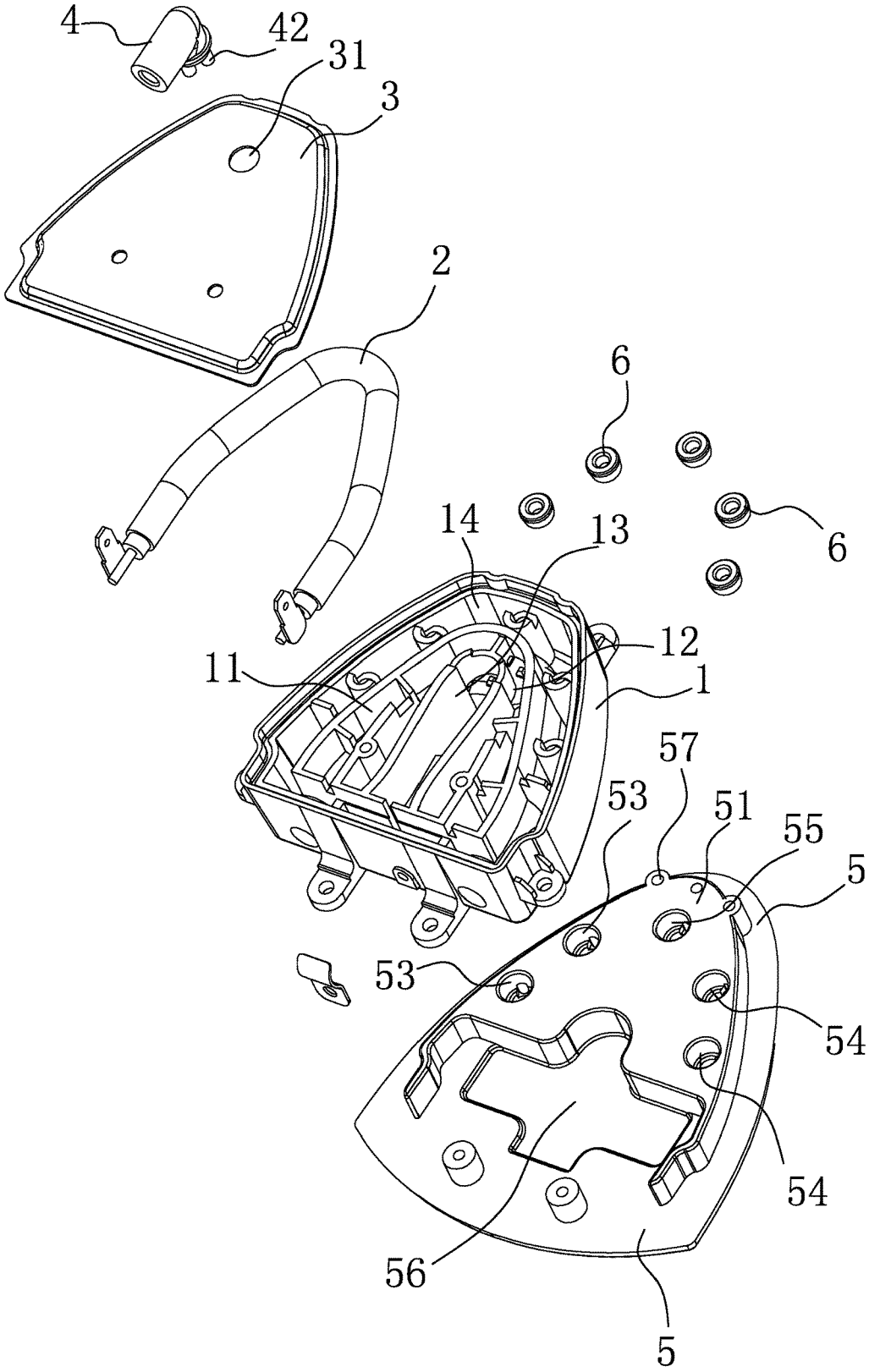
FIG. 5 is a decomposition diagram of a steam ironing machine with multiple water inlet points and multi-cavity isolated water paths of the present invention.

As shown in FIG. 1, FIG. 3 and FIG. 5, a steam ironing machine with multiple water inlet points and multi-cavity isolated water paths comprises a heating body 1, wherein a heating pipe 2 is arranged on the heating body 1; a sealing cover 3 is mated and fixed with the heating body 1; a water supply nozzle 4 is arranged on the sealing cover 3; an ironing board 5 is connected to one side of the heating body 1 away from the sealing cover 3; and a temperature sensor (not shown, the same below) is arranged between the heating body 1 and the ironing board 5.

As shown in FIG. 1, FIG. 3 and FIG. 5, the heating body 1 is concavely provided with a first containing cavity 11, a second containing cavity 12 and a third containing cavity 13 which are mutually isolated and independently arranged; the heating body 1 is concavely provided with an accommodating cavity 14 outside the first containing cavity 11, the second containing cavity 12 and the third containing cavity 13; the accommodating cavity 14 is arranged around the first containing cavity 11, the second containing cavity 12 and the third containing cavity 13; the heating pipe 2 is in the same shape as the accommodating cavity 14 and is arranged in the accommodating cavity 14; and a locating slot 18 is formed at the junction of the first containing cavity 11, the second containing cavity 12 and the third containing cavity 13 and has a bottom surface 19 and three side surfaces 20. The heating body 1 is provided with a first steam outlet nozzle 15, a second steam outlet nozzle 16 and a third steam outlet nozzle 17 which are respectively in communication with the first containing cavity 11, the second containing cavity 12 and the third containing cavity 13. The number of the steam outlet nozzles may be more and exceed that of the containing cavities as long as each containing cavity corresponds to at least one steam outlet nozzle.

Figure 2:
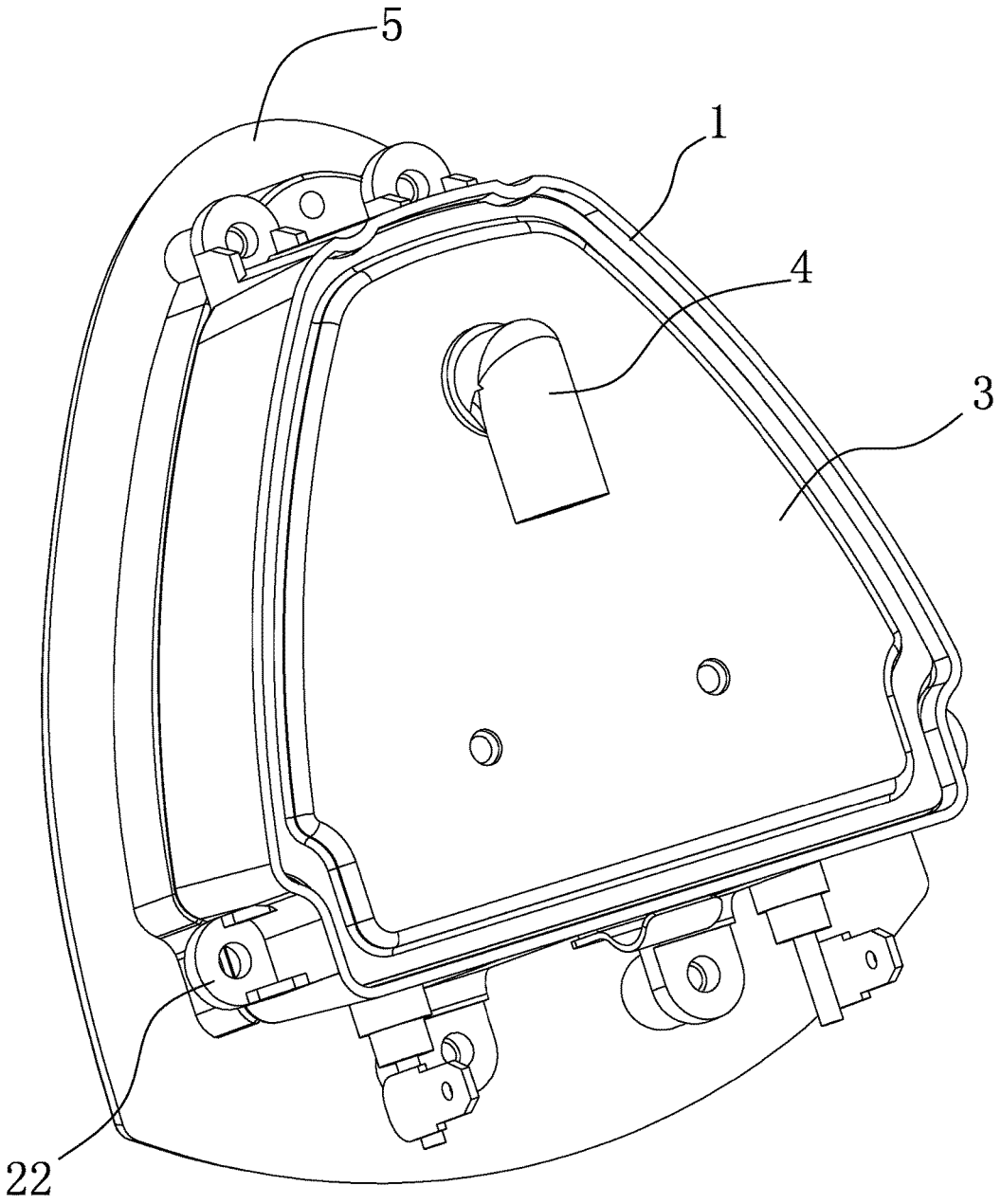
FIG. 2 is a schematic diagram of another visual angle of a steam ironing machine with multiple water inlet points and multi-cavity isolated water paths of the present invention.

As shown in FIG. 2, FIG. 3 and FIG. 5, the sealing cover is mated with the heating body 1 and covered on the first containing cavity 11, the second containing cavity 12, the third containing cavity 13 and the accommodating cavity 14; the first containing cavity 11 and the sealing cover 3 form an independent cavity, the second containing cavity 12 and the sealing cover 3 form an independent cavity, and the third containing cavity 13 and the sealing cover 3 form an independent cavity so that the ironing effect is more uniform. An open hole 31 is formed in the sealing cover 3.

Figure 6:
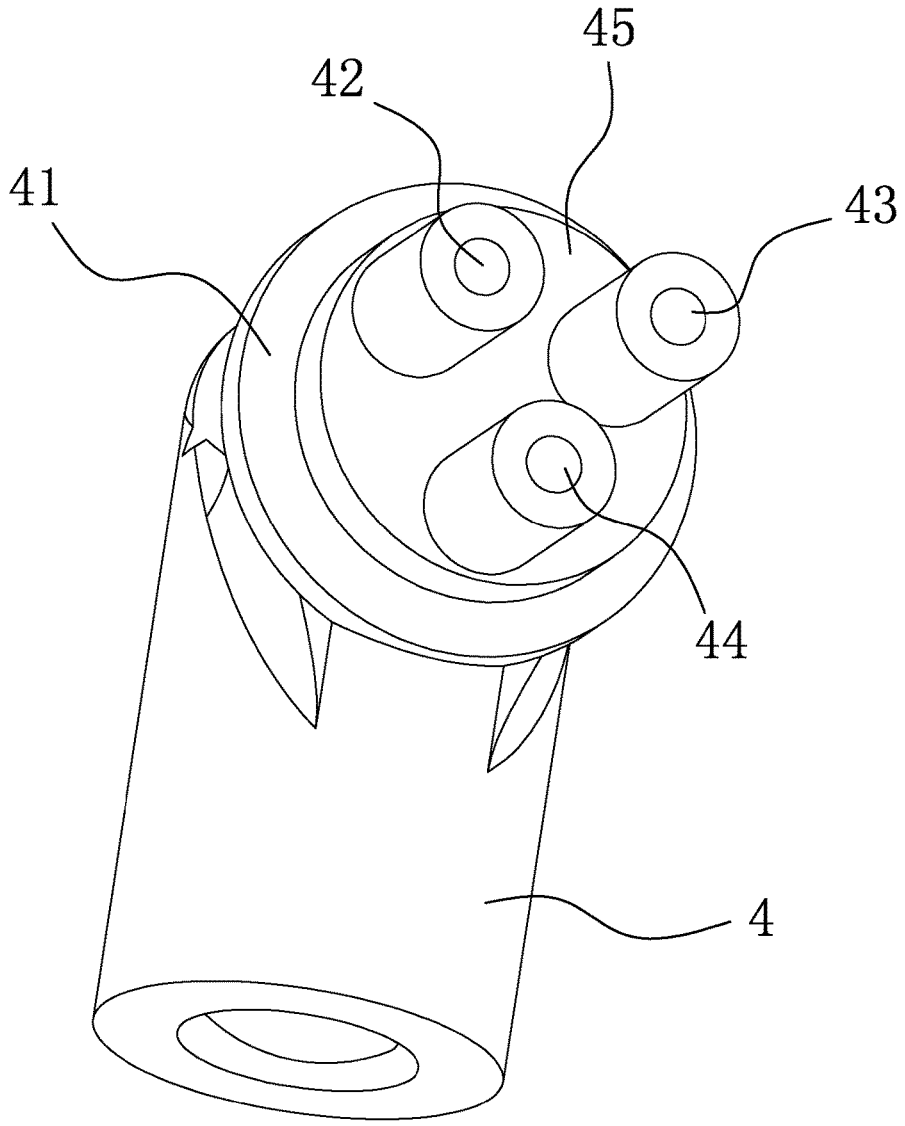
FIG. 6 is a schematic diagram of a water supply nozzle of a steam ironing machine with multiple water inlet points and multi-cavity isolated water paths of the present invention.

As shown in FIG. 2, FIG. 5 and FIG. 6, the water supply nozzle 4 is arranged on the sealing cover 3 and provided with a body part 41, and the body part 41 is abutted against the bottom surface 19 and the three side surfaces 20 to further perform the function of limiting. A first water inlet part 42, a second water inlet part 43 and a third water inlet part 44 are formed by extending from the body part 41 to the heating body 1 respectively; the body part 41 is located in the open hole 31; the first water inlet part 42, the second water inlet part 43 and the third water inlet part 44 are respectively contained in the first containing cavity 11, the second containing cavity 12 and the third containing cavity 13; the first water inlet part 42 and the first containing cavity 11 are in communication with each other; the second water inlet part 43 and the second containing cavity 12 are in communication with each other; the third containing cavity 13 and the third water inlet part 44 are in communication with each other; and the first water inlet part 42, the second water inlet part 43 and the third water inlet part 44 are arranged in triangle and distributed uniformly so that the ironing effect is more uniform and the structure is more stable. One end of the body part 41 away from the first water inlet part 42 is provided with a step part 45 which is abutted against the ironing surface 52 beside the open hole 31 to perform the function of limiting. The number of the water inlet parts may be more and exceed that of the containing cavities; the number of the steam outlet nozzles may be equal to, less than or more than that of the water inlet parts as long as each containing cavity corresponds to one water inlet part; and the specific number can be increased or decreased according to the actual demand of customers.

As shown in FIG. 1, FIG. 2 and FIG. 5, the ironing board 5 is connected to one side of the heating body 1 away from the sealing cover 3; the ironing board 5 has a contact surface 51 and an ironing surface 52; and the contact surface 51 is in close fit and contact with the heating body 1 to ensure airtightness as well as sufficient heat conduction. The heat of the heating body 1 is conducted to the ironing board 5 to perform the function of ironing. Under normal operating condition, the temperature of the ironing board 5 is not less than 100° C. to realize that no condensed water exists on the ironing board 5. The ironing board 5 is provided with a first through hole 53, a second through hole 54 and a third through hole 55 corresponding to the first steam outlet nozzle 15, the second steam outlet nozzle 16 and the third steam outlet nozzle 17; the first through hole 53, the second through hole 54 and the third through hole 55 respectively run through the contact surface 51 to the ironing surface 52; a seal 6 is arranged between the first steam outlet nozzle 15 and the first through hole 53; a seal 6 is arranged between the second steam outlet nozzle 16 and the second through hole 54; a seal 6 is arranged between the third steam outlet nozzle 17 and the third through hole 55; the first steam outlet nozzle 15 is put into the first through hole 53; the second steam outlet nozzle 16 is put into the second through hole 54; the third steam outlet nozzle 17 is put into the third through hole 55; and the seals 6 are made of silica gel so that the sealing effect is good and the service life is long. The first steam outlet nozzle 15 and the first through hole 53 are staggered with each other and form a first steam outlet passage (not shown, the same below); the second steam outlet nozzle 16 and the second through hole 54 are staggered with each other and form a second steam outlet passage (not shown, the same below); the third steam outlet nozzle 17 and the third through hole 55 are staggered with each other and form a third steam outlet passage (not shown, the same below); the first steam outlet passage is not in a straight line; the second steam outlet passage is not in a straight line; and the third steam outlet passage is not in a straight line. The first steam outlet passage, the second steam outlet passage and the third steam outlet passage are not a complete and direct passage and are respectively provided with a side branch passage to the ironing board 5, the bottom of the straight passage is blocked, and a space between the blocked bottom and the side branch passages is formed to store condensed water in order to prevent water droplets and condensed water from being directly sprayed out of the ironing board 5 to produce poor effect on ironing clothes. The first steam outlet nozzle 15 and the first through hole 53 are arranged in parallel with each other, the second steam outlet nozzle 16 and the second through hole 54 are arranged in parallel with each other, and the third steam outlet nozzle 17 and the third through hole 55 are arranged in parallel with each other, so that the passages are unblocked and steam can be smoothly sprayed out of the ironing board 5, wherein the number of the through holes can be set according to the same rule as the steam outlet nozzles.

Figure 4:
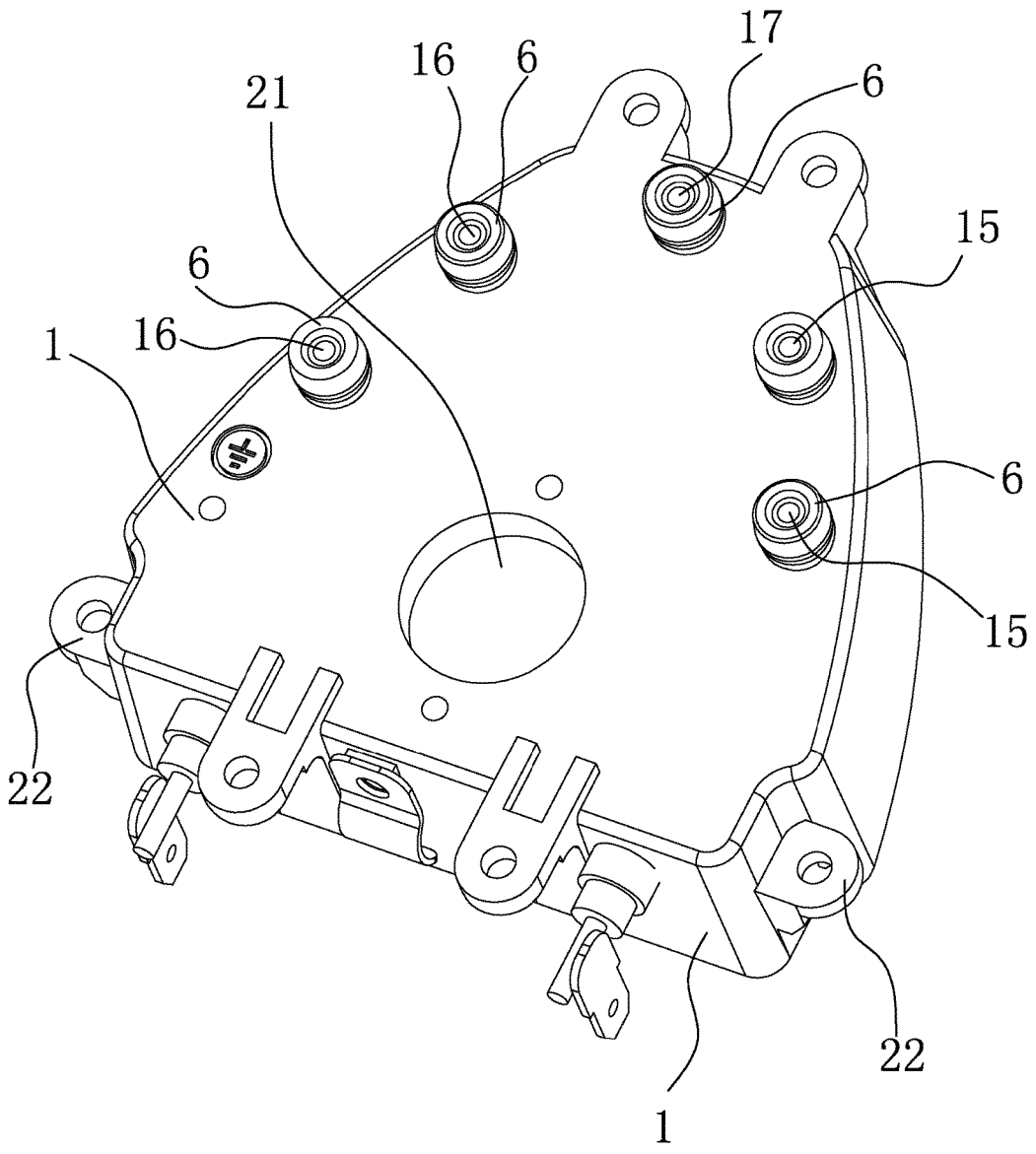
FIG. 4 is a schematic diagram of a steam ironing machine with multiple water inlet points and multi-cavity isolated water paths without an ironing board of the present invention.

As shown in FIG. 1, FIG. 4 and FIG. 5, a mounting hole 21 is concavely arranged in one side of the heating body 1 close to the ironing board 5; the ironing board 5 is provided with a concave part 56 in a position corresponding to the mounting hole 21; and a temperature controller is arranged in the mounting hole 21 and the concave part 56, so that the overall height of the steam ironing machine with multiple water inlet points and multi-cavity isolated water paths is not increased. Each side of the heating body 1 is provided with a fixed ring 22, the ironing board 5 is provided with fixed columns 57 corresponding to the fixed rings 22, internal threads (not shown, the same below) are formed in the fixed columns 57, and each fixed ring 22 and each fixed column 57 are fixed by a bolt stably.

As shown in FIG. 1, FIG. 3 and FIG. 5, in the steam ironing machine with multiple water inlet points and multi-cavity isolated water paths, the first containing cavity 11 and the second containing cavity 12 are mutually isolated and independently arranged; the heating body 1 is concavely provided with the accommodating cavity 14 outside the first containing cavity 11 and the second containing cavity 12; the heating pipe 2 is arranged in the accommodating cavity 14; the sealing cover 3 is mated with the heating body 1 and covered on the first containing cavity 11, the second containing cavity 12 and the accommodating cavity 14; the water supply nozzle 4 is arranged on the sealing cover 3 and provided with the first water inlet part 42 and the second water inlet part 43 corresponding to the first containing cavity 11 and the second containing cavity 12; the first water inlet part 12 and the first containing cavity 11 are in communication with each other; the second water inlet part 43 and the second containing cavity 12 are in communication with each other; the ironing board 5 is connected to one side of the heating body 1 away from the sealing cover 3; the heating body 1 is provided with the first steam outlet nozzle 15 and the second steam outlet nozzle 16 which are respectively in communication with the first containing cavity 11 and the second containing cavity 12; the ironing board 5 has the contact surface 51 and the ironing surface 52; the first through hole 53 and the second through hole 54 are formed in the ironing board 5 corresponding to the first steam outlet nozzle 15 and the second steam outlet nozzle 16; the first through hole 53 and the second through hole 54 respectively run through the contact surface 51 to the ironing surface 52; the temperature sensor is arranged between the heating body 1 and the ironing board 5 so that the temperature of the ironing surface 52 can be ensured and clothes will not be spoiled due to overtemperature; and the first containing cavity 11 and the second containing cavity 12 are arranged to prevent the problems that condensate water is produced on the ironing board 5 when the steam ironing machine operates and water is sprayed due to excessive water on one side when the steam ironing machine leans to one side.

The above only describes the preferred embodiments of the present invention, but is not intended to limit the patent scope of the present invention. Therefore, any equivalent technical change made by using contents of the specification and drawings of the present invention shall be contained within the patent scope of the present invention.

What is claimed is:

1. A steam ironing machine with multiple water inlet points and multi-cavity isolated water paths, characterized by comprising: a heating body which is concavely provided with at least one first containing cavity and at least one second containing cavity, wherein the first containing cavity and the second containing cavity are mutually isolated and independently arranged, and the heating body is concavely provided with an accommodating cavity outside the first containing cavity and the second containing cavity; a heating pipe is arranged in the accommodating cavity; a sealing cover is mated with the heating body and is covered on the first containing cavity, the second containing cavity and the accommodating cavity; a water supply nozzle is arranged on the sealing cover and is provided with a first water inlet part and a second water inlet part corresponding to the first containing cavity and the second containing cavity; the first water inlet part and the first containing cavity are in communication with each other, and the second water inlet part and the second containing cavity are in communication with each other; an ironing board is connected to one side of the heating body away from the sealing cover; the heating body is provided with at least one first steam outlet nozzle and at least one second steam outlet nozzle which are respectively in communication with the first containing cavity and the second containing cavity; the ironing board has a contact surface and an ironing surface; a first through hole and a second through hole are formed in the ironing board corresponding to the first steam outlet nozzle and the second steam outlet nozzle; the first through hole and the second through hole respectively run through the contact surface to the ironing surface; and a temperature sensor is arranged between the heating body and the ironing board.

2. The steam ironing machine with multiple water inlet points and multi-cavity isolated water paths of claim 1, characterized in that: a seal is arranged between the first steam outlet and the first through hole, another seal is arranged between the second steam outlet and the second through hole, and the seals are made of silica gel.

3. The steam ironing machine with multiple water inlet points and multi-cavity isolated water paths of claim 1, characterized in that: each side of the heating body is provided with a fixed ring, the ironing board is provided with fixed columns corresponding to the fixed rings, internal threads are formed in the fixed columns, and each fixed ring and each fixed column are fixed by a bolt.

4. The steam ironing machine with multiple water inlet points and multi-cavity isolated water paths of claim 1, characterized in that: a mounting hole is concavely formed in one side of the heating body close to the ironing board, the ironing board is provided with a concave part in a position corresponding to the mounting hole, and a temperature controller is arranged in the mounting hole and the concave part.

5. The steam ironing machine with multiple water inlet points and multi-cavity isolated water paths of claim 1, characterized in that: the first containing cavity and the sealing cover form an independent cavity, the second containing cavity and the sealing cover form another independent cavity, and the contact surface is in close fit and contact with the heating body.

6. The steam ironing machine with multiple water inlet points and multi-cavity isolated water paths of claim 1, characterized in that: the heating body is concavely provided with at least one third containing cavity; correspondingly, the water supply nozzle is provided with a third water inlet part, and the third containing cavity and the third water inlet part are in communication with each other; the first water inlet part, the second water inlet part and the third water inlet part are arranged in triangle and distributed uniformly; correspondingly, the heating body is provided with a third steam outlet nozzle, and a third through hole is formed in the ironing board; and the third containing cavity is in communication with the third steam outlet nozzle and the third through hole.

7. The steam ironing machine with multiple water inlet points and multi-cavity isolated water paths of claim 6, characterized in that: an open hole is formed in the sealing cover, the water supply nozzle is provided with a body part; the first water inlet part, the second water inlet part and the third water inlet part are formed by extending from the body part to the heating body respectively; the body part is located in the open hole; and the first water inlet part, the second water inlet part and the third water inlet part are respectively contained in the first containing cavity, the second containing cavity and the third containing cavity.

8. The steam ironing machine with multiple water inlet points and multi-cavity isolated water paths of claim 7, characterized in that: one end of the body part away from the first water inlet part is provided with a step part which is abutted against the ironing surface beside the open hole.

9. The steam ironing machine with multiple water inlet points and multi-cavity isolated water paths of claim 7, characterized in that: a locating slot is formed at the junction of the first containing cavity, the second containing cavity and the third containing cavity, the locating slot has a bottom surface and at least three side surfaces, and the body part is abutted against the bottom surface and the three side surfaces.

10. The steam ironing machine with multiple water inlet points and multi-cavity isolated water paths of claim 1, characterized in that: the first steam outlet nozzle and the first through hole are staggered with each other and form a first steam outlet passage, the second steam outlet nozzle and the second through hole are staggered with each other and form a second steam outlet passage, the first steam outlet passage is not in a straight line, the second steam outlet passage is not in a straight line, the first steam outlet nozzle and the first through hole are arranged in parallel with each other, and the second steam outlet nozzle and the second through hole are arranged in parallel with each other.

* * * * *